US007267199B2

(12) United States Patent
Farrara et al.

(10) Patent No.: US 7,267,199 B2
(45) Date of Patent: Sep. 11, 2007

(54) PADDED END CAP FOR VEHICLE LIFTING HOIST ARM

(75) Inventors: Roger A. Farrara, Chico, CA (US); Kenneth E. Jones, Chico, CA (US)

(73) Assignee: Rafken, Inc., Chico, CA (US)

( * ) Notice: Subject to any disclaimer, the term of this patent is extended or adjusted under 35 U.S.C. 154(b) by 203 days.

(21) Appl. No.: 10/810,393

(22) Filed: Mar. 25, 2004

(65) Prior Publication Data

US 2004/0211946 A1 Oct. 28, 2004

Related U.S. Application Data

(60) Provisional application No. 60/458,175, filed on Mar. 26, 2003.

(51) Int. Cl.
*B66F 7/00* (2006.01)

(52) U.S. Cl. ..... 187/203; 187/204

(58) Field of Classification Search ..... 187/218, 187/204

See application file for complete search history.

(56) References Cited

U.S. PATENT DOCUMENTS 4,161,090 A * 7/1979 Watts, Jr. ..... 52/301
4,190,988 A * 3/1980 Carreiro ..... 52/16
5,803,126 A * 9/1998 Zaro ..... 138/89
5,984,058 A * 11/1999 Danneker ..... 188/312
6,006,479 A * 12/1999 Fayle ..... 52/300
6,244,390 B1 * 6/2001 Yeo et al. ..... 187/211
6,273,215 B1 * 8/2001 Horan et al. ..... 187/203
6,805,221 B1 * 10/2004 Lee ..... 182/107
6,931,792 B2 * 8/2005 McDonald et al. ..... 52/12

OTHER PUBLICATIONS

Technical Data Sheet: VHB Acrylic Foam Tape 3M. May 2002 (Copy Enclosed).
Technical Data Sheet: 3M Tape Primer Feb. 1998 (Copy Enclosed).

* cited by examiner

*Primary Examiner*—Patrick Mackey
*Assistant Examiner*—Terrell Matthews
(74) *Attorney, Agent, or Firm*—William Bodnar

(57) ABSTRACT

A padded end cap made of resilient material for cushioning the end of lifting hoist arms of automotive lifts. One embodiment of this solid body cushioning apparatus (10) contains a plurality of vertical and horizontal attachment surfaces to affix the apparatus to the substantially square or rectangular end of a vehicle lifting arm. Another solid body embodiment provides at least one concave attachment surface to affix the cushioning apparatus to the substantially cylindrical, circular or semi-circular end of a vehicle lifting arm.

6 Claims, 5 Drawing Sheets

PADDED END CAP FOR VEHICLE LIFTING HOIST ARM

CROSS REFERENCE TO RELATED APPLICATIONS

This application claims priority from U.S. Provisional Patent Application No. 60/458,175 filed Mar. 26, 2003. The contents of U.S. Provisional Patent Application No. 60/458,175 are fully incorporated herein by reference.

FIELD OF THE INVENTION

This present invention relates to automotive lift assemblies, particularly a padded end cap for the end of lifting hoist arms of the automotive lifts.

BACKGROUND OF THE INVENTION

Automotive lift systems are well known is the art, particularly in the automotive servicing field, where a technician must often raise a vehicle to a predetermined height above the ground in order to make appropriate repairs. Automotive lift assemblies can be constructed in a variety of configurations but typically have four lifting arms which the vehicle rests on. The lifting arms are extendable to support the vehicle at prescribed load bearing positions.

All automotive lifting arms are made of metal and most are square or rectangular in shape. The ends of the lift arms are also predominately square or rectangular in shape. Some manufacturers however, include a cylindrical attachment at the end of their lifting arms to hold a vehicle support stand.

Regardless of the shape of the lifting arm and/or its end, all commercially available lift arms are comprised of metal. There is no evidence of any device available to attach to the end of the lifting arms to provide a surface softer than metal, i.e., a cushioning surface.

SUMMARY OF THE INVENTION

This present invention is a padded end cap for cushioning the end of the lifting arms on automotive lifts. This article of manufacture supplies a low-cost, durable product that can be easily fitted to the end of the lifting arms of an automotive lift system.

The object of the padded end cap is to provide a surface on the end of the lifting arm that is softer than the composition of the lifting arm.

A further object of an embodiment of the invention is to provide a low-cost, durable device that can be utilized by manufacturers of automotive lift systems as well as commercial operators or home users of new or existing use automotive lifts. This device can be attached to the end of each lifting arm on an automotive lift by any of the means listed herein as well as other suitable attachment means known by those skilled in the art.

Another advantage of an embodiment of the padded end cap of the present invention is to lessen the effect of injuries to a person coming in contact with the end of the hoist arm. This is accomplished in part by the shape, location and cushioning properties of the end cap.

Additional advantages and novel features of the present invention will be set forth in part in the description which follows, and in part will become apparent to those skilled in the art upon examination of the following, or may be learned by practice of the invention. The advantages of the invention may be realized and attained by means of the instrumentalities and combinations particularly pointed out in the appended claims.

BRIEF DESCRIPTION OF DRAWINGS

The character of the invention, however, may be best understood by reference to one of its structural forms, as illustrated by the accompanying drawings, in which.

DETAILED DESCRIPTION OF THE PREFERRED EMBODIMENTS

Figure 1:
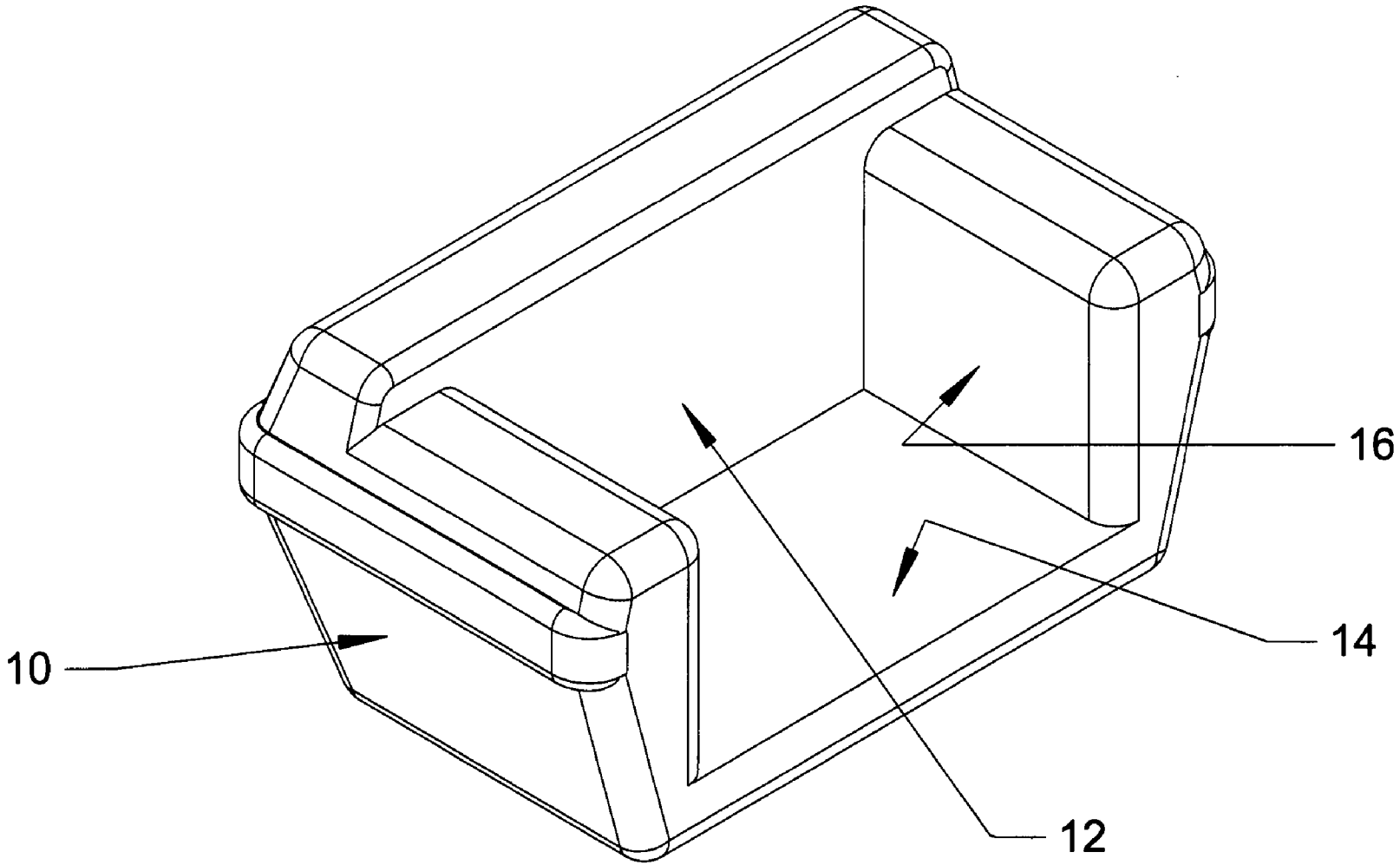
FIG. 1 is a perspective view of a padded end cap with a plurality of attachment surfaces for affixing the padded end cap to a lifting arm.

Referring to FIG. 1, which best shows the general features of one embodiment of the invention, a vehicle lifting arm padded end cap (10) is shown with a plurality of attachment surfaces. The one-piece lifting arm padded end cap was produced via a compression molded process utilizing closed cell foam materials. The padded end cap can be produced utilizing any resilient material including, but not limited to, expanded foam, rubber, extruded foam rubber, sponge foam polyurethane foam, integral skin foams, rigid closed cell, integral flexible open cell, expanded polystyrene or compression-molded, closed cell cross-linked polyethylene or other suitable materials. These processes are utilized in manufacturing industries and well known to those skilled in the art.

The FIG. 1 embodiment has a plurality of attachment surfaces for affixing the padded end cap to the end of a lifting arm. Item 12 is a vertical back attachment surface. Item 14 is a horizontal bottom attachment surface. Item 16 is a vertical side attachment surface. There are two opposing vertical attachment surfaces. The configuration of the embodiment shown in FIG. 1 is best suited to fit on the end of a lifting arm that has a square or rectangular shape. The attachment surfaces shown are set against the corresponding end, sides and bottom of a square or rectangular lifting arm.

Padded end caps may be attached to the vehicle lifting arm by, but not limited to, the following means: magnetic, spring clips, hook and loop fastener, tie straps, nuts, bolts, screws, snug-fit, slip on, double sided tape, or adhesives.

Figure 2A:
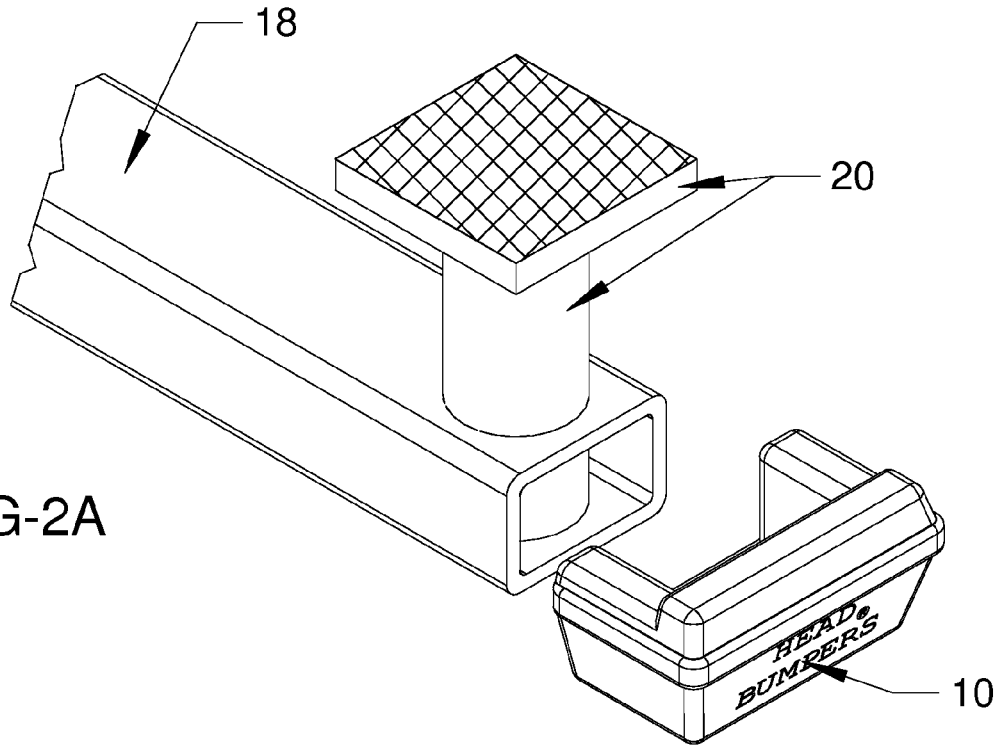
FIG. 2*a* is a perspective view of a padded end cap offset from the end of a lifting arm.

FIG. 2*a* shows a typical rectangular lifting arm (18) with a vehicle support stand (20). A padded end cap (10) is shown offset from the end of the lifting arm (18).

Figure 2B:
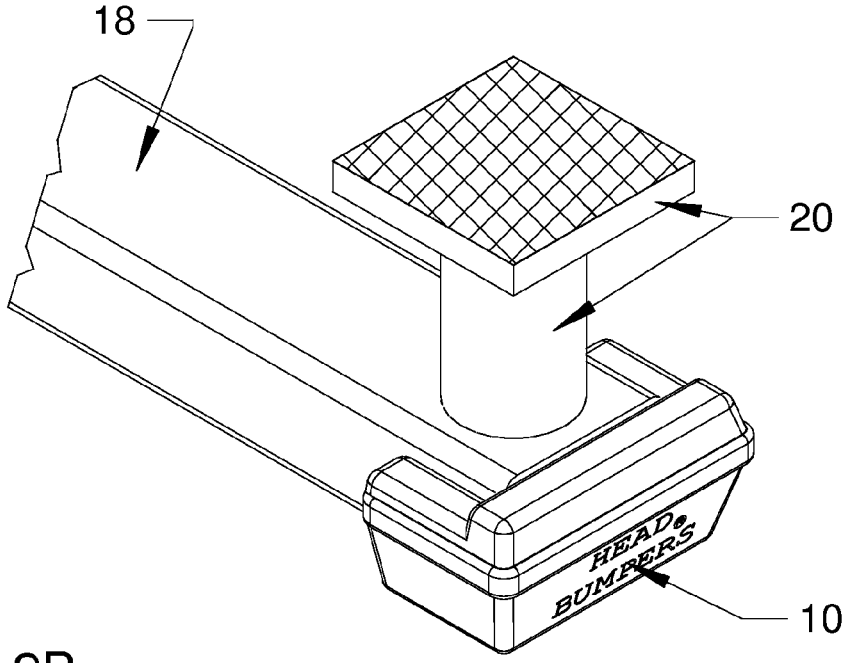
FIG. 2*b* is a perspective view of a padded end cap in place on the end of a lifting arm.

FIG. 2*b* shows a typical rectangular lifting arm (18) with a vehicle support stand (20) and an attached padded end cap (10). FIGS. 2*a* and 2*b* also show indicia on an exterior surface.

Figure 3A:
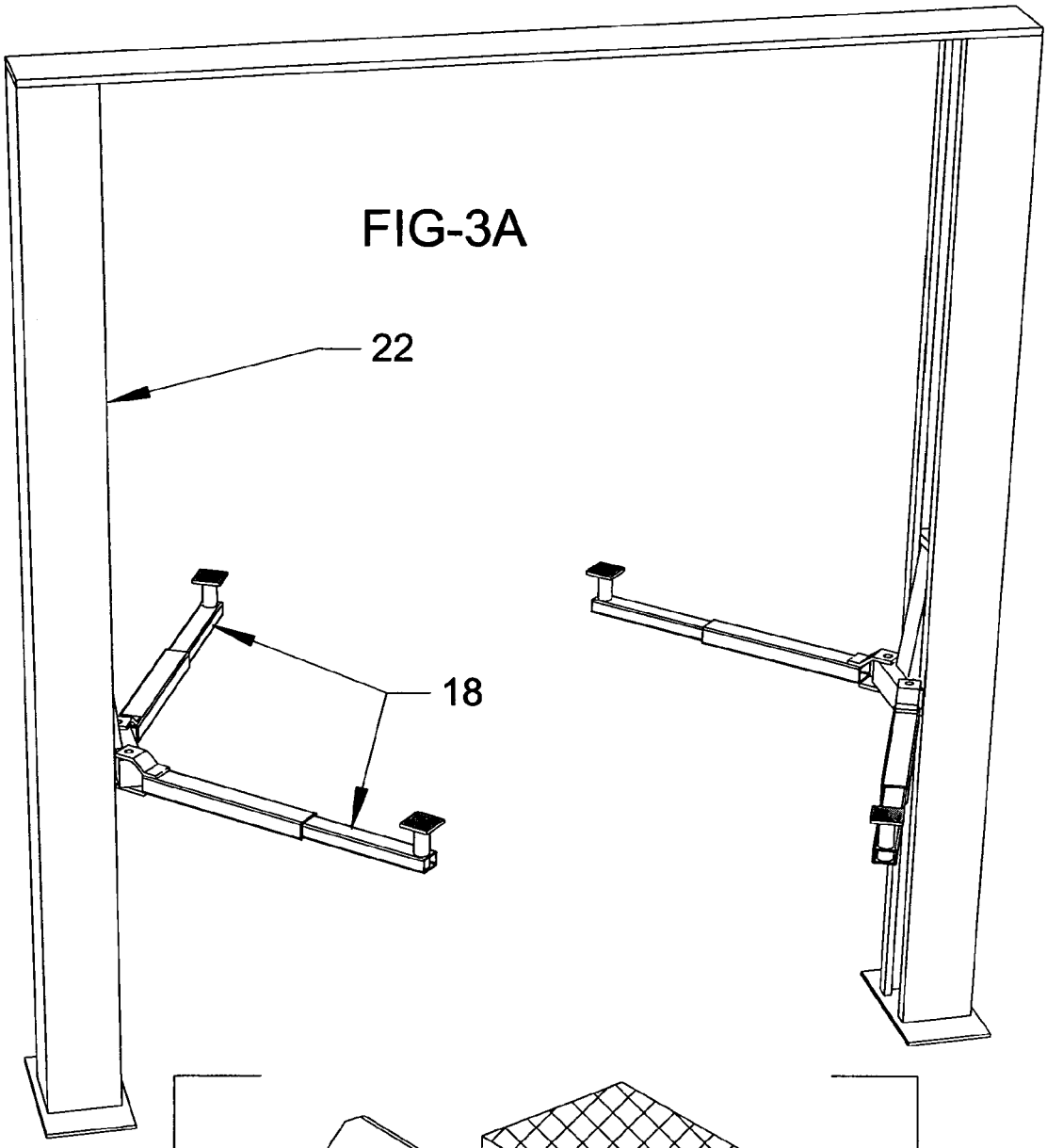
FIG. 3*a* is a perspective view of a two-post automotive lift system with four vehicle-lifting arms.

A typical two-post aboveground automotive lift system is shown in FIG. 3*a*. Two vehicle lifting arms (18) are attached to each support post (22).

Figure 3B:
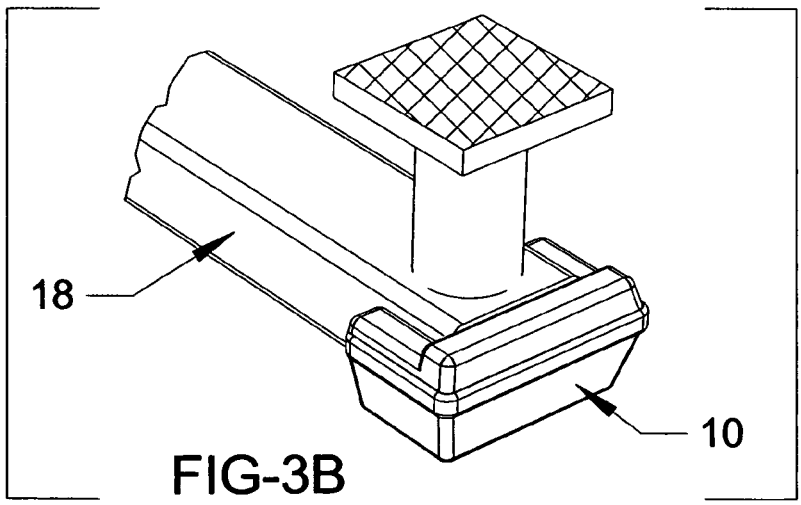
FIG. 3*b* is a perspective view of a padded end cap in place on the end of a lifting arm.

FIG. 3*b* offers a view of a lifting arm (18) with an attached padded end cap (10) in place.

Figure 4:
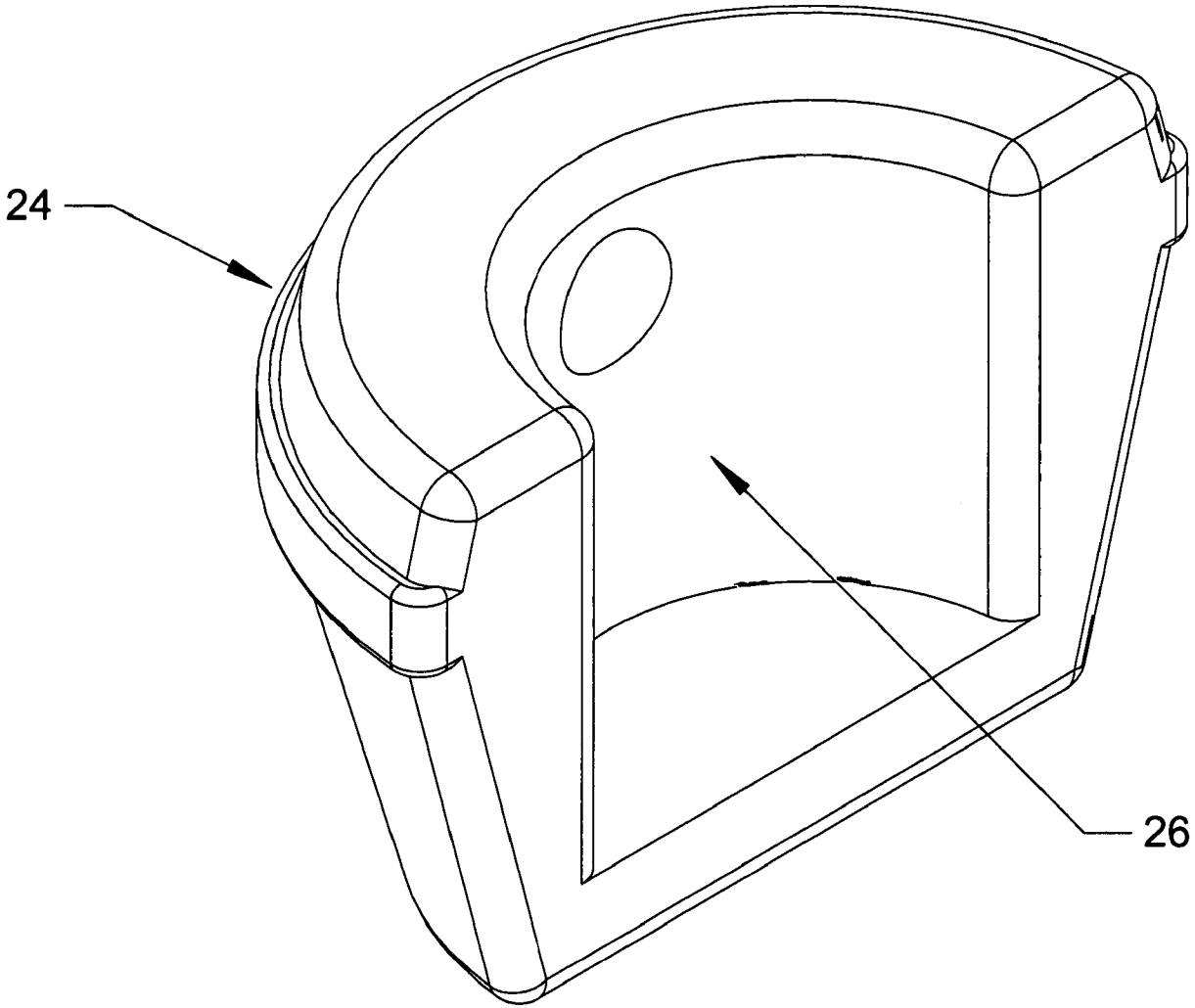
FIG. 4 is a perspective view of a cylindrical or semi-circular shaped padded end cap.

FIG. 4 shows a cylindrical or semi-circular padded end cap (24) with one concave attachment surface (26).

Figure 5A:
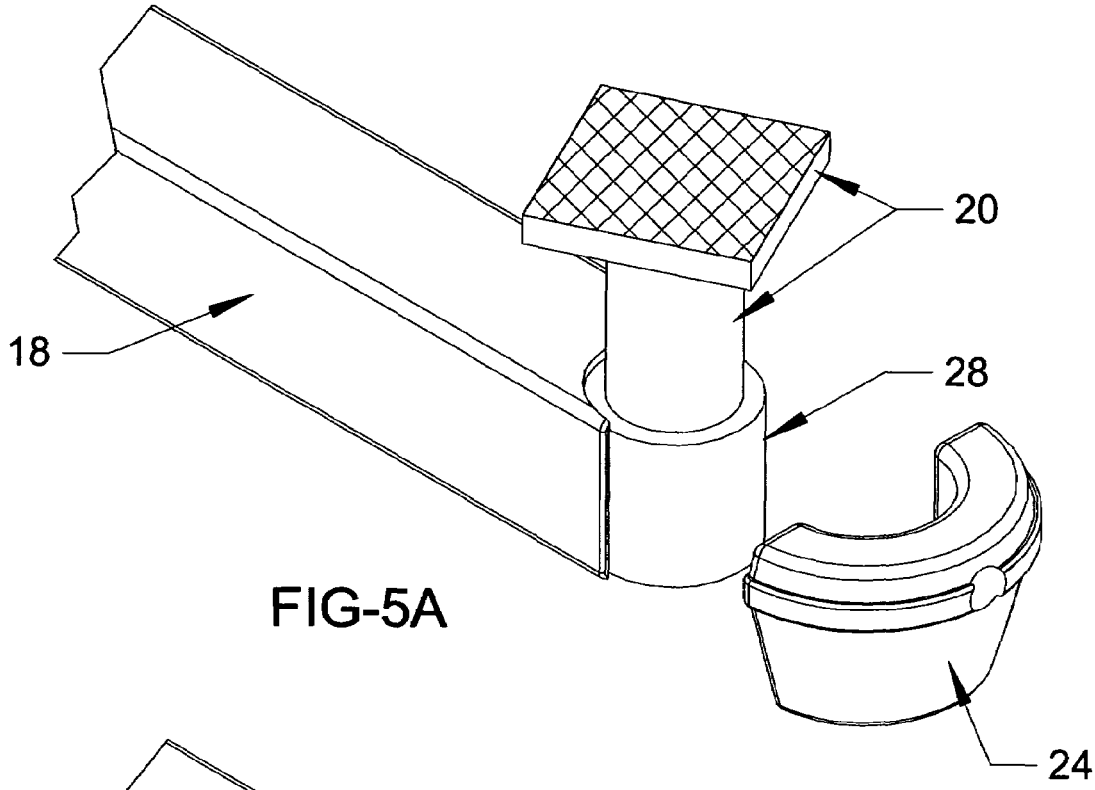
FIG. 5*a* is a perspective view of a cylindrical or semi-circular padded end cap offset from the cylindrical end of a lifting arm.

FIG. 5*a* illustrates a square or rectangular lifting arm (18) with an attached cylindrical base (28) to hold a vehicle support stand (20). Offset from the end of the lifting arm is a cylindrical or semi-circular padded end cap (24).

Figure 5B:
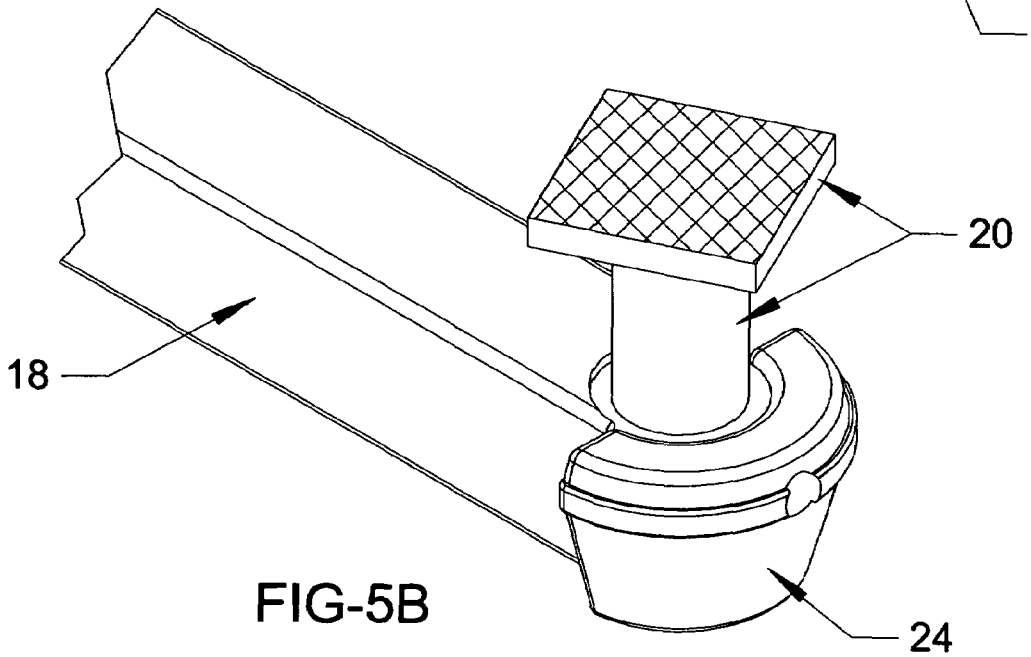
FIG. 5*b* is a perspective view of a cylindrical or semi-circular padded end cap affixed to the cylindrical end of a lifting arm.

FIG. 5*b* shows a square or rectangular lifting arm (18) with an attached cylindrical base (28) to hold a vehicle support stand (20). A semi-cylindrical or semi-circular padded end cap (24) is attached to the cylindrical base.

CONCLUSIONS, OTHER EMBODIMENTS, AND SCOPE OF INVENTION

The padded end cap described herein is a new and useful device attached to the end of a vehicle lift arm on automotive lifts. This article of manufacture can be utilized on a variety of vehicle lift arms and can lessen the effect of injuries caused by a person coming in contact with the end of the lift or hoist arm. Embodiments of the padded end cap can be manufactured to fit all types of vehicle lift arm end configurations.

Thus, although there have been described particular embodiments of the present invention of a new and useful padded end cap, it is not intended that such references be construed as limitations upon the scope of this invention. Various modifications, alternate constructions and equivalents can be employed without departing from the true spirit and scope of the invention. Therefore, the above description and interrelated drawings shall not be construed as limiting the invention. The actual scope of the invention is defined by the breadth of the appended claims.

What is claimed is:

1. In combination:

An automotive lift system lifting arm having a substantially rectangular or square end;

A cushioning cap connected to the substantially rectangular or square end of the lifting arm, said cushioning cap having a substantially open top comprising: a solid body of resilient material having a plurality of exterior surfaces, said solid body further comprising: a front section; two adjacent side sections orthogonal to the front section; and a bottom section substantially orthogonal to the side sections and the front section.

2. The combination according to claim 1 wherein at least one of the exterior surfaces of said cushioning cap contains indicia.

3. The combination according to claim 1 wherein said solid body of resilient material is comprised of at least one member selected from the group consisting of expanded foam, rubber, extruded foam rubber, sponge foam, polyurethane foam, integral skin foams, rigid closed cell, integral flexible open cell, expanded polystyrene and compression-molded, closed cell cross-linked polyethylene.

4. In combination:

An automotive lift system lifting arm substantially curvilinear end;

A cushioning cap connected to the substantially curvilinear end of the lifting arm, said cushioning cap having a substantially open top and comprising: a solid body of resilient material having a curvilinear shape, at least one exterior surface, and at least one concave interior attachment surface for affixing said cushioning cap to the curvilinear end of an arm of an automotive lift system.

5. The combination of according to claim 4 wherein the at least one exterior surface of said cushioning cap contains indicia.

6. The combination according to claim 4 wherein said solid body of resilient material is comprised of at least one member selected from the group consisting of expanded foam, rubber, extruded foam rubber, sponge foam, polyurethane foam, integral skin foams, rigid closed cell, integral flexible open cell, expanded polystyrene and compression-molded, closed cell cross-linked polyethylene.

* * * * *